US007600814B2

(12) United States Patent
Link

(10) Patent No.: US 7,600,814 B2
(45) Date of Patent: Oct. 13, 2009

(54) SEATING FURNITURE ITEM, IN PARTICULAR OFFICE CHAIR

(75) Inventor: Werner Link, Messstetten (DE)

(73) Assignee: Interstuhl Bueromoebel GmbH & Co. KG, Messstetten (DE)

( * ) Notice: Subject to any disclaimer, the term of this patent is extended or adjusted under 35 U.S.C. 154(b) by 0 days.

(21) Appl. No.: 11/868,616

(22) Filed: Oct. 8, 2007

(65) Prior Publication Data

US 2008/0084102 A1 Apr. 10, 2008

(30) Foreign Application Priority Data

Oct. 10, 2006 (DE) ..... 10 2006 047 889

(51) Int. Cl.

| | |
|---|---|
| ***A47C 3/026*** | (2006.01) |
| ***A47C 1/025*** | (2006.01) |
| ***A47C 1/026*** | (2006.01) |
| ***A47C 1/032*** | (2006.01) |
| ***A47C 1/038*** | (2006.01) |

(52) U.S. Cl. ..... 297/300.2; 297/300.5

(58) Field of Classification Search ..... 297/300.5, 297/300.2

See application file for complete search history.

(56) References Cited

U.S. PATENT DOCUMENTS

| | | | | |
|---|---|---|---|---|
| 4,384,741 | A * | 5/1983 | Flum et al. | 297/300.5 |
| 4,854,641 | A * | 8/1989 | Reineman et al. | 297/300.2 X |
| 4,962,962 | A * | 10/1990 | Machate et al. | 297/300.5 |
| 5,775,774 | A * | 7/1998 | Okano | 297/300.2 |
| 5,810,439 | A * | 9/1998 | Roslund, Jr. | 297/300.2 X |
| 5,873,634 | A * | 2/1999 | Heidmann et al. | 297/300.2 X |
| 6,234,573 | B1 * | 5/2001 | Roder et al. | 297/300.5 |
| 6,431,649 | B1 * | 8/2002 | Hensel | 297/300.2 |
| 6,709,058 | B1 * | 3/2004 | Diffrient | 297/300.2 X |
| 6,712,428 | B2 * | 3/2004 | Moreschi | 297/300.5 X |
| 6,886,888 | B2 * | 5/2005 | Bock | 297/300.2 |
| 2004/0140702 | A1 * | 7/2004 | Daeschle et al. | 297/300.5 |

FOREIGN PATENT DOCUMENTS

| | | |
|---|---|---|
| DE | 42 16 159 | 11/1993 |
| DE | 295 10 715 | 10/1995 |
| DE | 20 2005 010 952 | 10/2005 |
| DE | 20 2005 004 880 | 8/2006 |
| EP | 0 339 089 | 11/1989 |
| EP | 1 258 211 | 11/2002 |
| EP | 1 491 116 | 12/2004 |

* cited by examiner

*Primary Examiner*—Rodney B White
(74) *Attorney, Agent, or Firm*—Michael J. Striker

(57) ABSTRACT

A seating furniture item, in particular an office chair, has a seat fastened on a seat support and a backrest fastened to a backrest support, the backrest support being articulatedly arranged on a base support and the backrest support and the seat support being articulatedly connected with each other via two levers, and in which one of the two levers is positively guided directly on the base support.

7 Claims, 4 Drawing Sheets

SEATING FURNITURE ITEM, IN PARTICULAR OFFICE CHAIR

CROSS-REFERENCE TO A RELATED APPLICATION

The invention described and claimed hereinbelow is also described in German Patent Application DE 10 2006 047 889.4 filed on Oct. 10, 2006. This German Patent Application, whose subject matter is incorporated here by reference, provides the basis for a claim of priority of invention under 35 U.S.C. 119(a)-(d).

BACKGROUND OF THE INVENTION

The invention relates to a seating furniture item, in particular an office chair, with a seat fastened to a seat support and with a backrest fastened to a backrest support, in which the backrest support is articulatedly arranged on a base support and the backrest support and the seat support are connected articulatedly with each other via two levers.

Such a seating furniture item is already known from the German Utility Model DE 20 2005 010 952 U1. It is distinguished by the possibility of a synchronous adjustment of the backrest and the seat, in which no relative movement occurs between the backrest and the clothing of a person who is seated. In addition, the lower part of the person's back remains well supported in all inclination positions of the backrest.

However, in the known seating furniture item a third lever is provided, which is mounted swivellably on the base support and positively guides the rear of the two levers which connect the seat support and the backrest support with each other. The known construction of the synchronous mechanism between the backrest and the seat is relatively complex due to the third lever which is required.

SUMMARY OF THE INVENTION

Accordingly, it is an object of the present invention to create a valve system with position detection of a valve element which is improved compared to conventional valve systems.

The problem is solved by a seating furniture item, which is characterized according to the invention in that one of the two levers is positively guided directly on the base support.

In the seating furniture item according to the invention, a third lever can therefore be dispensed with. Expediently, in addition, the front of the two levers, which is in any case arranged more closely on the base support, can be positively guided thereon. Hereby, more favourable conditions of forces are produced for the positive guidance.

In a preferred embodiment, the lever can be positively guided by means of a toothing on the base support. The toothings of the lever and base support can lie here on circular arc sections, so that the lever can roll like the cogwheel of a planetary gear on the base support, when the inclination of the seat and of the backrest is adjusted. This type of positive guidance is very robust and dispenses with movable parts between the lever and the base support.

The articulation points of the levers on the backrest support and on the seat support can all be arranged beneath the rear half of the seat, independently of the swivel position of the levers. In this way, an ergonomic synchronous adjustment of the seat and backrest can be achieved.

Expediently, in addition, one of the levers, preferably the positively guided lever, can be pre-stressed by means of a spring element in one of its end positions of the swivel movement. Here, the end position will be selected in which the backrest is placed vertically. The pre-stressing by the spring element makes provision that the chair is moved back into a defined position when it is not loaded.

In addition, the spring element determines the force which a user of the chair must exert in order to adjust the backrest and the seat in their position. In order to be able to set this force to persons of differing body weight, the articulation point of the spring element on the lever can be adjustable.

As the lever swivels when the backrest and the seat are being adjusted, the articulation point of the spring element also moves. In order that this articulation point remains fixed in its preset position on the lever and does not move further during the movement of the lever, a clamping lever with a connecting link guide can be provided. A pin or suchlike which is arranged on the backrest support can engage into the connecting link guide.

Furthermore, the position of the lever and hence the position of the seat and backrest can be able to be arrested in a desired position by the user of the chair. For this, a detent slider can be used, for example. This can be arranged on the backrest support and can be brought into engagement with the toothing of the base support. The position of the backrest support and of the seat support which is coupled with it via the levers is thereby fixed with respect to the stationarily arranged base support.

In addition, the front edge of the seat can be able to be lowered by means of an adjustment member in order to better adapt the seating furniture item to persons with different lengths of lower leg.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
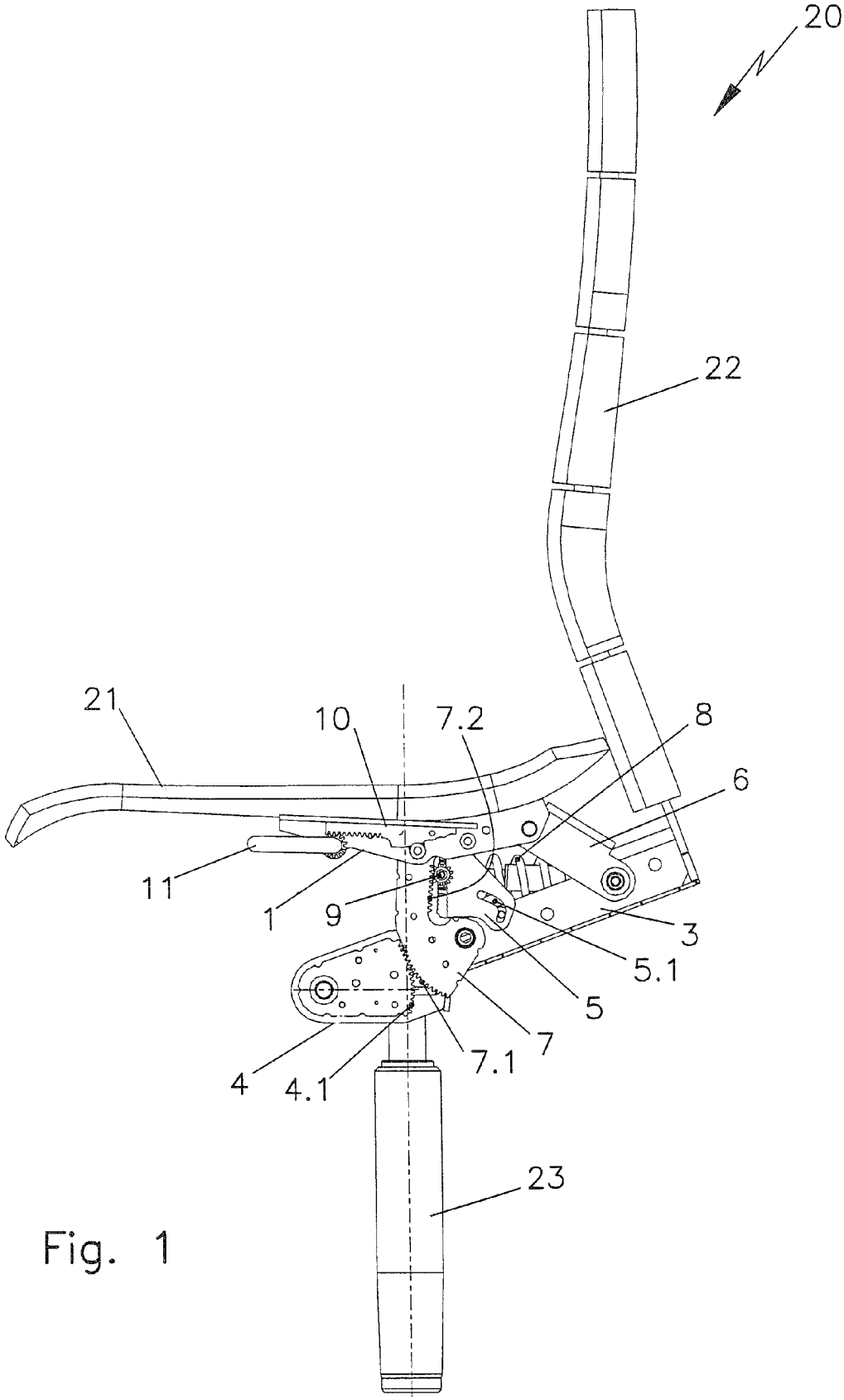
FIG. 1 shows a side view of a seating furniture item according to the invention, with an upright backrest position.

The drawings show in the various figures respectively an office chair 20 with a seat 21 and a backrest 22. As FIG. 1 shows, the office chair 20 has a chair column 23 at the lower end of which an X-base with runners can be arranged, which is not illustrated here. A base support 4 is fastened to the upper end of the chair column 23. A backrest support 3 is articulatedly mounted on this base support 4. The seat 21 rests on a seat support 1 which is articulately connected with the backrest support 3 via two levers 7 and 6.

The base support 4 and the lever 7 respectively have a toothing 4.1 and 7.1 which engage into each other. The toothings 4.1 and 7.1 lie respectively on circular arcs, so that the lever 7 can roll with its toothing 4.1 on the toothing 4.1 of the base support 4 like the cogwheel of a planetary gear, when it is swivelled. The lever 7 and therewith the entire synchronous mechanism for the seat 21 and the backrest 22, consisting of the backrest support 3, the seat support 1 and the two levers 6, 7, is consequently positively guided via the toothings 4.1 and 7.1.

FIG. 1 shows the chair 20 with an upright position of the backrest 22. The lever 7 is in its foremost swivel position. In this position, it is pre-stressed by a spring element 8. Its articulation point 9 on the lever 7 is adjustable in accordance with the physical weight of the user of the chair. To do this, the lever 7 has a second toothing 7.2, along which the articulation point 9, which is provided with a small cogwheel, can be moved up and down.

The further up the articulation point 9 is situated, the more strongly the spring element 8 is pre-stressed, i.e. the force is all the greater which is required to lower the backrest 22 toward the rear. For lighter persons, it is therefore expedient to move the articulation point 9 downwards with respect to the position shown in FIG. 1. In order that the position of the articulation point 9, once it has been selected, no longer moves with respect to the lever 7, when the lever 7 is swivelled by lowering of the backrest 22, a clamping lever 5 with a connecting link guide 5.1 is provided.

The clamping lever 5 likewise has a toothing, into which the cogwheel of the articulation point 9 engages. A pin or suchlike of the backrest support 3 projects into the connecting link guide 5.1. The lever 5 is thereby co-swivelled parallel to the lever 7 when the backrest 22 is lowered, and clamps the articulation point 9 securely in its position.

Figure 2:
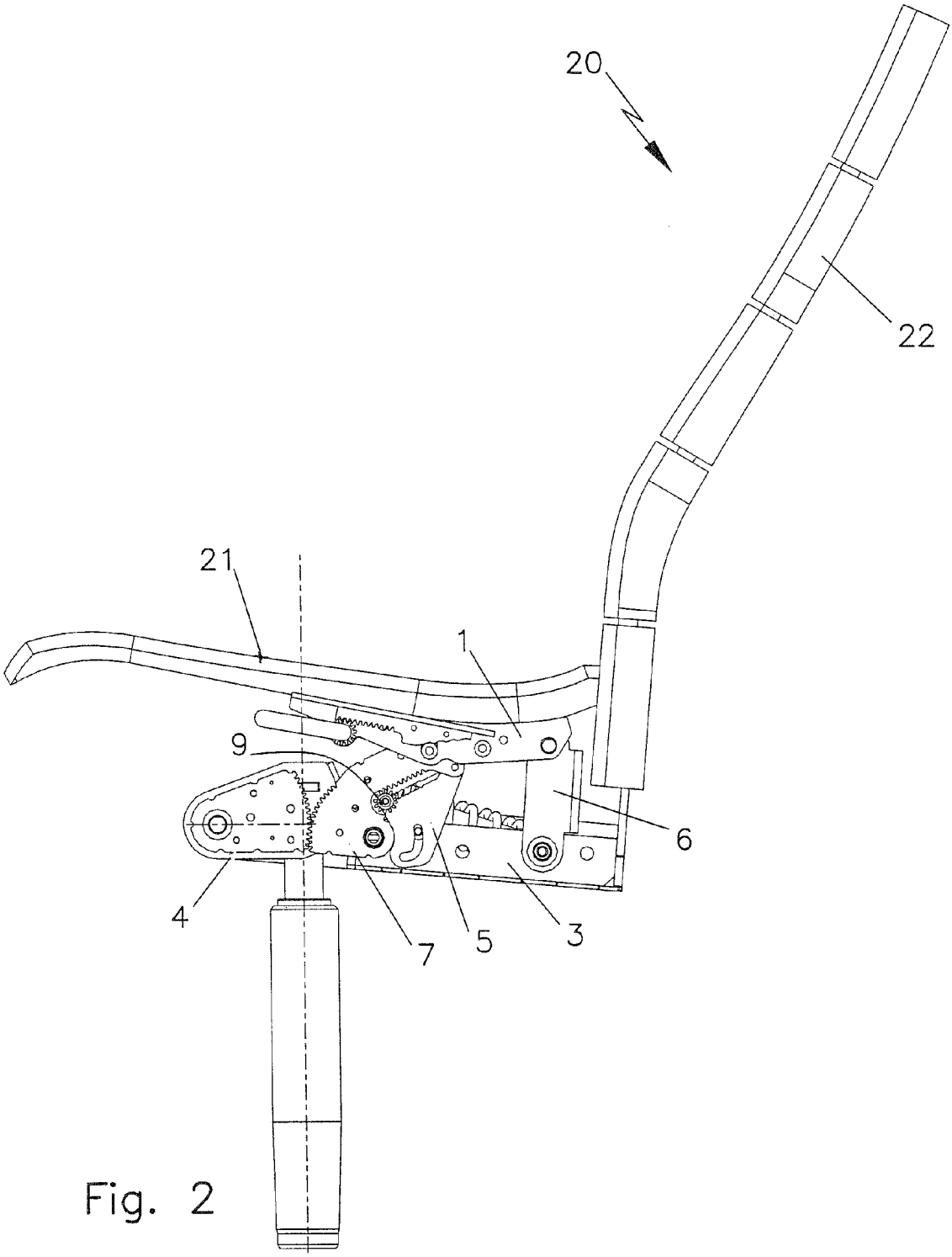
FIG. 2 shows a side view of the seating furniture item of FIG. 1, with a lowered backrest position.

FIG. 2 now shows the chair 20 of FIG. 1 with the backrest 22 lowered toward the rear. The levers 6,7 and the clamping lever 5 have been swivelled into their most extreme right position. At the same time as the backrest 22, the seat 21 has also lowered itself downwards in its rear region. Through the synchronous mechanism according to the invention and the arrangement of all the rotation points of the levers 6,7 beneath the rear half of the seat 21, the rear edge is the seat 21 thereby always remains closely adjacent to the backrest 22, so that on lowering of the backrest and of the seat, a displacement of the clothing of the chair user can not take place and his back also always remains well supported in the region of the lumbar vertebrae.

Figure 3:
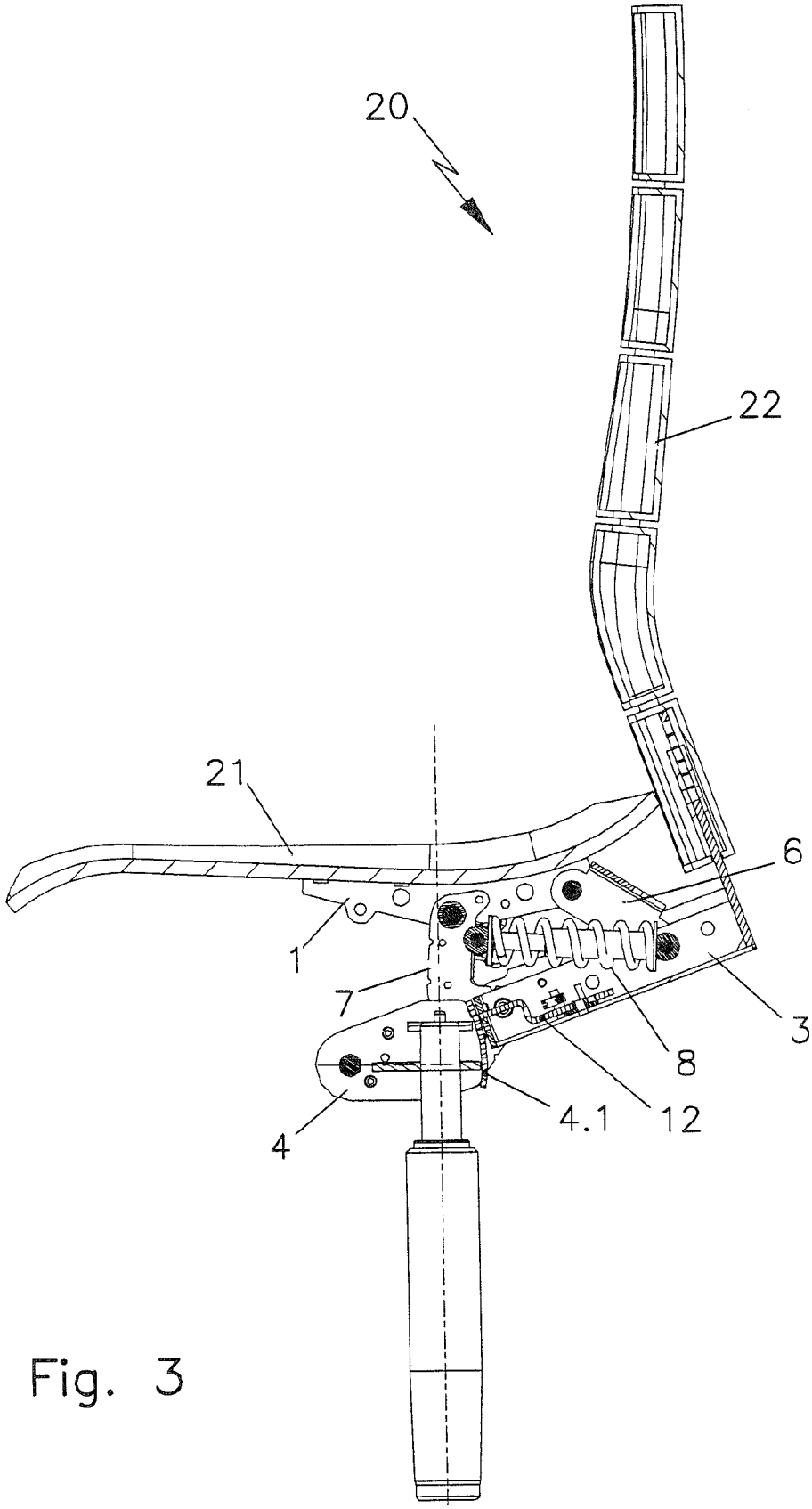
FIG. 3 shows a longitudinal section through the seating furniture item of FIG. 1.

FIG. 3 shows in a sectional view of the chair 20 a possibility for arresting the position of seat 21 and backrest 22. To do this, a detent slider 12 is arranged on the backrest support 3, said detent slider being able to be brought into engagement with the toothing 4.1 of the base support 4 and thereby blocking the further movement of the backrest support 3.

Figure 4:
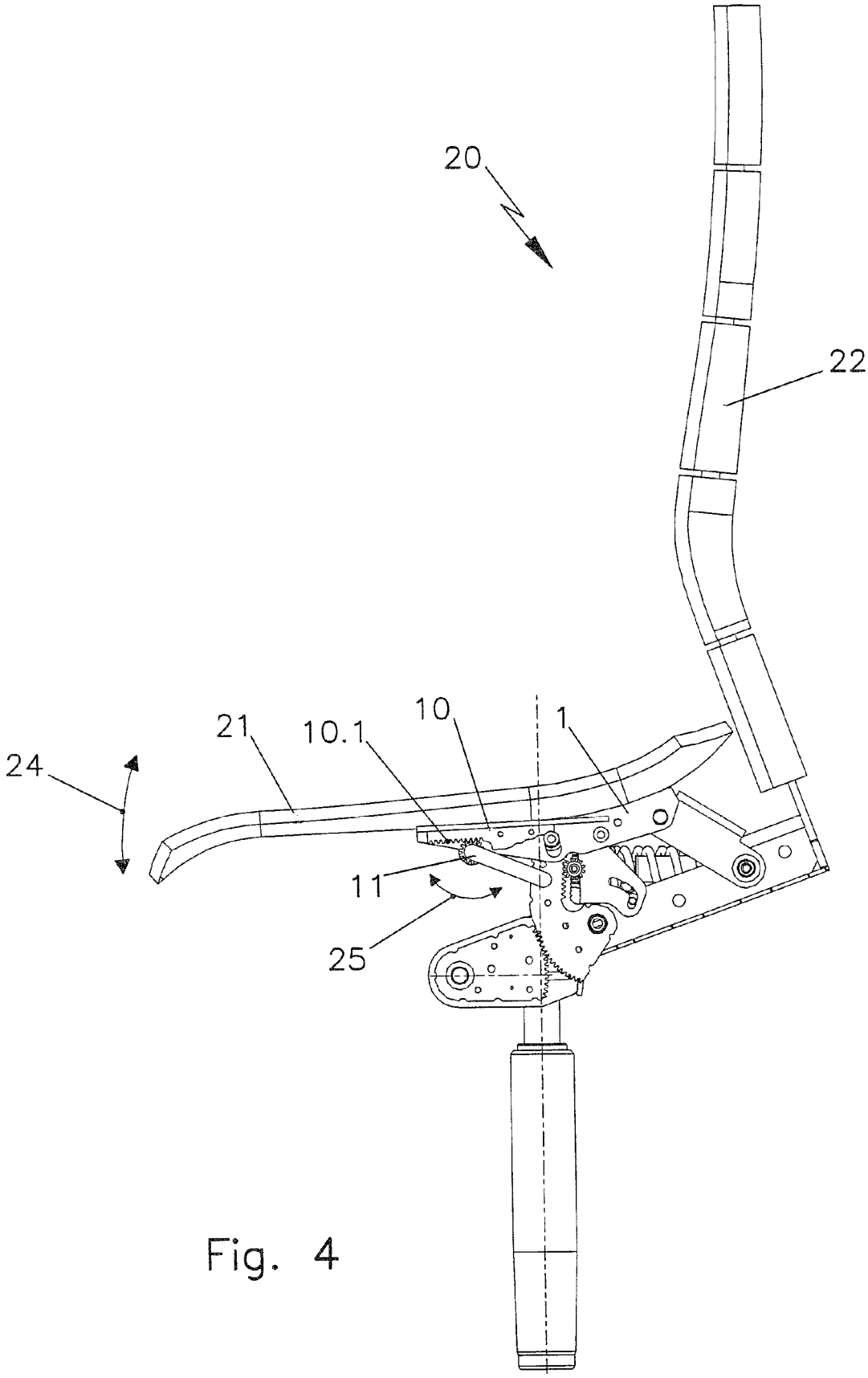
FIG. 4 shows a side view of the seating furniture item, corresponding to FIG. 1, with a lowered front edge of the seat.

Finally, in FIG. 4, it is shown how the front edge of the seat 21 can be lowered or raised along the direction of the double arrow 24. To do this, a wedge slider 10 which has a toothing 10.1 is arranged on the seat support 1. A cogwheel arranged on an operating lever 11 is in engagement with this toothing 10.1

When the operating lever 11 is swivelled toward the rear along the double arrow 25, the front edge of the seat 21 is lowered, as is shown in FIG. 4. On the other hand, FIG. 1 shows the operating lever 11 in its front swivel position. The front edge of the seat 21 is now raised compared with the position in FIG. 4. In this way, the chair 20 can be adapted in a simple manner to persons having lower legs of different length.

It will be understood that each of the elements described above, or two or more together, may also find a useful application in other types of constructions differing from the type described above.

While the invention has been illustrated and described as embodied in a seating furniture item, in particular office chair, it is not intended to be limited to the details shown, since various modifications and structural changes may be made without departing in any way from the spirit of the present invention.

Without further analysis, the foregoing will so fully reveal the gist of the present invention that others can, be applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

The invention claimed is:

1. A seating furniture item, comprising a seat support; a backrest support; a base support; a seat fastened on said seat support; a backrest fastened to said backrest support, said backrest support being articulately arranged on said base support, and said backrest support and said seat support being articulately connected with each other via two levers, one of said levers being positively guided directly on said base support, wherein articulation points of said levers on said backrest support and on said seat support are arranged independently of a swivel position of said levers beneath a rear half of said seat, and wherein said base support and said backrest support are not connected directly but only via said two levers.

2. A seating furniture item as defined in claim 1; and further comprising a toothing for positively guiding said one lever on said base support.

3. A seating furniture item as defined in claim 1; and further comprising a spring element for prestressing one of said levers in one end position of a swivel movement of said one lever.

4. A seating furniture item as defined in claim 3, wherein an articulation point of said spring element on said one lever is adjustable.

5. A seating furniture item as defined in claim 3; and further comprising a clamping lever which is configured for fixing an articulation point of said spring element during a swivel movement of said one lever.

6. A seating furniture item as defined in claim 1, wherein a position of said at least one lever and therefore positions of said seat and said backrest are arrestable.

7. A seating furniture item as defined in claim 1; and further comprising an adjusting member by which a front edge of said seat is lowerable.

* * * * *